United States Patent [19]

Heider et al.

[11] Patent Number: 4,723,092

[45] Date of Patent: Feb. 2, 1988

[54] METHOD OF MAKING A SINGLE-ENDED METAL HALIDE HIGH-PRESSURE DISCHARGE LAMP, AND SINGLE-ENDED LAMP MADE ACCORDING TO THE METHOD

[75] Inventors: Jürgen Heider, Munich; Jürgen Vom Scheidt, Taufkirchen; Ewald Wurster, Grünwald; Alexander Dobrusskin, Taufkirchen, all of Fed. Rep. of Germany

[73] Assignee: Patent-Treuhand-Gesellschaft für elektrische Glühlampen mbH, Munich, Fed. Rep. of Germany

[21] Appl. No.: 915,713

[22] Filed: Oct. 6, 1986

[30] Foreign Application Priority Data

Oct. 24, 1985 [DE] Fed. Rep. of Germany ..... 3537879
Oct. 24, 1985 [DE] Fed. Rep. of Germany ..... 3537880

[51] Int. Cl.[4] ..... H01J 9/32

[52] U.S. Cl. ..... 313/634; 313/318; 313/332; 65/55; 65/59.26

[58] Field of Search ..... 445/22, 26, 27; 313/318, 332; 65/55, 59.26, 59.7, 282; 313/634

[56] References Cited

U.S. PATENT DOCUMENTS

| | | | |
|---|---|---|---|
| 3,609,212 | 9/1971 | Lewis | 313/317 X |
| 4,542,316 | 9/1985 | Hall et al. | 313/318 |
| 4,668,204 | 5/1987 | English et al. | 445/26 |

FOREIGN PATENT DOCUMENTS

| | | |
|---|---|---|
| 47308 | 1/1972 | Japan . |
| 1442497 | 7/1976 | United Kingdom . |

*Primary Examiner*—Kenneth J. Ramsey
*Attorney, Agent, or Firm*—Frishauf, Holtz, Goodman & Woodward

[57] ABSTRACT

To improve the high-voltage flash-over resistance by increasing the lead separation of the lamps, the pinch or press seal is, while the lamp is being made and the lamp tubing is in plastically deformable condition, extended at least is the region adjacent the end of the later formed pinch seal by introducing spreader jaws, either parallel or, at least eventually, in acutely angled relation to each other into the softened end portion, and then spreading apart the jaws so that, at the outer end portions of the jaws, the plastically deformable region will assume an oval shape whose longer dimension is wider than the outer diameter of the tubing in the region which will later from the discharge vessel.

15 Claims, 9 Drawing Figures

FIG.6
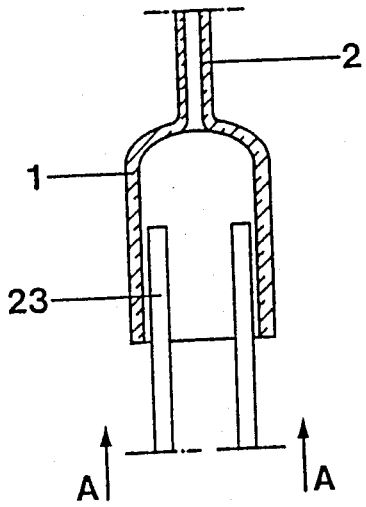
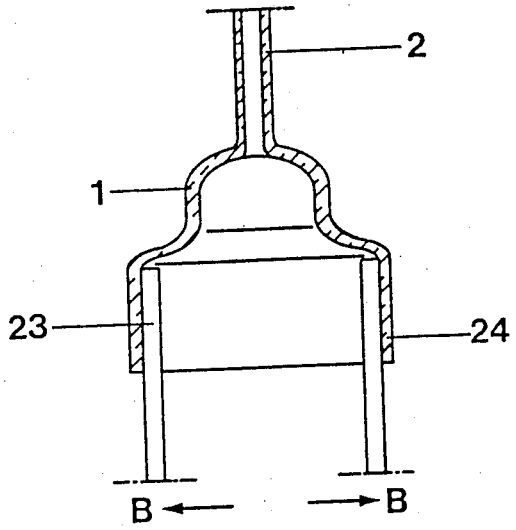
FIG.7

FIG. 8
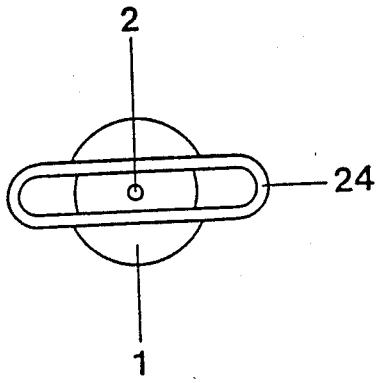
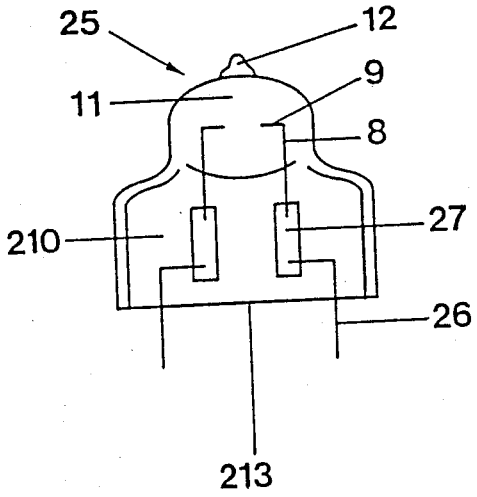
FIG. 9

METHOD OF MAKING A SINGLE-ENDED METAL HALIDE HIGH-PRESSURE DISCHARGE LAMP, AND SINGLE-ENDED LAMP MADE ACCORDING TO THE METHOD

Reference to related patent publications:

U.S. Pat. No. 3,617,797, the disclosure of which is hereby incorporated by reference; Japanese Utility Model Application No. 47-308; British Pat. No. 1,442,497; U.S. Ser. No. 915,714, filed Oct. 6, 1986 inventors: DOBRUSSKIN, HEIDER and GOSSLAR (claiming priority German Application No. P 35 37 878.6 of Oct. 24, 1985).

The present invention relates to metal halide or halogen high-pressure discharge lamps, and to a method of making the lamps, in which the lamps are single-ended or single-based and lamp current leads are carried out from a press or pinch seal.

BACKGROUND

Many metal halide discharge lamps are formed in a single-ended or single-based construction, in which a discharge vessel, typically of quartz glass, is provided, through which lead connections are carried; the discharge vessel is sealed by a pinch or press seal. To permit sealing the discharge connection through the pinch seal, external connecting wires or pins are secured to molybdenum metal foils which, in turn, are connected to the electrodes within the lamp. The pinch seal or press seal is formed in the region of the molybdenum foils, surrounding also the immediately adjacent portions of the connecting wires. The molybdenum foils extend parallel to each other, within the glass, and are located in a plane within the pinch or press seal, to be retained flat therein. In accordance with customary production techniques, the pinch seal is made in this manner:

(1) A circular cylindrical glass tube or cane is provided which, later on, will form the discharge vessel; an exhaust and fill gas supply and pump tube is connected thereto;

(2) a portion of the glass tubing, somewhat below the attachment of the pump tube, is heated to a temperature sufficient so that the glass of the tubing becomes plastically deformable;

(3) a subassembly of the electrode system, which includes the external current supply leads, the sealing foils, and the electrodes to be located within the discharge vessel, are introduced into the region of the glass tube which has been heated to plastically deformable temperature from the end remote from the pump tube; heating can also be done only after introducing the electrode system while holding it in a suitable holder;

(4) pinch jaws are then moved from diametrically opposite sides of the tubing towards the heated region of the tubing, the jaws being shaped to form dies or molds for the pinch seal to be made; the width of the pinch seal will be approximately the same as the diameter of the cylindrical tubing of the discharge vessel;

(5) the portion of the tube, now sealed at one end with the electrodes introduced, is evacuated and a fill is introduced through the pump tube, and the pump tube is tipped off.

In order to insure that the vessel is tight, that is, tightly sealed, it is customary to utilize sealing foils made of molybdenum in vessels in which the tubing is made of quartz glass. Continuous wire elements passing from the outside of the lamp into the lamp and carrying the lamp electrodes cannot be reliably sealed through quartz glass. The continuous trend towards miniaturization, and the demand for discharge lamps of lower output power, results in smaller sizes of the discharge vessels and, further, smaller sizes of the pinch seal, in which the sealing foils of molybdenum are embedded. Difficulties have arisen to maintain the required distance between the relatively wide sealing foils to be introduced through the pinch seal. These sealing foils are located in a single plane, and the maintenance of the spacing between the facing edges of the sealing foils, within the small and narrow pinch seal, is difficult. The electrodes have to be spaced from each other by some minimum spacing which is determined not by the operating voltage of the lamp but, rather, by the voltage of a voltage pulse which is necessary to cause the lamp to start or ignite. Depending on the temperature state of the lamp, an ignition voltage of at least 6 $kV_p$ must be applied to insure reliable starting.

In order to provide for the necessary insulation of the external current leads, it has previously been proposed to carry the current leads out from the pinch seal at an angle and to insulate the current leads from each other by glass tubes which are filled with a filling material and closed off by an elastic plastic substance (see British Pat. No. 1,442,497). This results in complex manufacturing steps which raise the price of the lamp out of proportion to the remaining manufacturing costs. The quartz insulating tubes which are comparatively long are subject to breakage and, in case they should break, the electrical insulation capability of the electrode leads is substantially impaired.

It has also been proposed to bend the sealing foils within the press seals by about 90° towards the outside, so that the spacing of the external current supply leads is increased—see Japanese Utility Model Publication No. 47-308. Handling the sealing foils of molybdenum—which foils have a thickness of only a few hundredths mm (a few $10^{-5}$ m) thickness is very difficult and unsuitable. Reliability and durability upon passage of current through foils so treated is substantially reduced.

U.S. Pat. No. 3,617,797 describes an arrangement in which the current leads are carried out laterally from the press or pinch seal. This lamp is designed for use in an optical system, and the particular placement of the external connecting leads is arranged to permit the filament to have a predetermined distance from the end of the base; the press seal can be changed in its length subsequently to the original manufacture so that the position of the filament can be matched to the respective optical system.

THE INVENTION

It is an object to provide a method to make the lamp, and a lamp which has a pinch seal which is so made that the necessary width of the leads and sealing foils can be readily accomodated within the pinch seal. The lamp permits application of high voltage to the supply leads, that is, voltage of at least 6 $kV_p$. Manufacture of the press seal, and the introduction of the electrode system, as well as of the electrode system itself is simple so that a sturdy, reliable lamp can be inexpensively manufactured.

Briefly, a pair of spreader pins or jaws are introduced into the plastically deformable glass tubing, the jaws or pins then being spread apart to deform the initially circular tubing into oval form, at least at the mouth of the tubing and where the pinch seal is to be effected. Thus, the plastically deformable tubing will have a region of wider opening, although the dimension transverse to the width dimension will be narrowed, so that, in end view, the opening will define an oval. The maximum dimension of the opening will be enlarged with respect to the original diameter of the tubing.

In accordance with a feature of the invention, the pins or jaws introduced into the plastically deformable tubing define an acute angle with respect to each other. After the introduction of the spreader jaws, the spreader jaws are spread apart, so that the tubing, in the range of the introduction of the spreader jaws, will have an oval cross section in end view whereas, in side view, it will have generally conical or triangular shape, with a width which is greater than the diameter of the originally circular cylindrical tubing, and a transverse dimension at the end of the tubing; the inner portion of this conically deformed end may be identical to the originally circular tubing, or also slightly deformed; the diameter of this inner portion will be at least approximately the same as the diameter of the circular tubing.

In accordance with another feature of the invention, the spreader jaws are introduced in a direction parallel to each other and spread parallel to the major direction of the lamp so that, in the region of introduction of the spreader jaws, the tubing will be deformed to have an oval cross section throughout, with a larger dimension which is greater than the dimension of the circular cylindrical tubing.

Regardless of whether the spreader jaws are angled with respect to each other or parallel with respect to each other—and also with respect to the major axis of the tube—the pinch seal is carried out by forming the pinching operation on the deformed end portion of the tubing, so that the sealing foils which are introduced into the pinch seal will be spread apart, and wider from each other at the end portion of the pinch seal, resulting in increased separation of the connecting leads from each other, and thus contributing to the resistance against high-voltage flash-over of the lamp, and the leads leading thereto. The pinch seal is formed in accordance with standard procedure, the only difference between the formation of the pinch seal in accordance with the present invention and that of the prior art being that the jaws which form the pinch seal, of course, must be shaped to accept the widened pinch seal, that is, wider than the original diameter of the tubing in accordance with the shape to which the tubing has been deformed by the spreader jaws.

The seal has the advantage that, although the spacing of the electrodes within the discharge vessel formed by the subsequently tipped-off tubing can be in accordance with prior art design dimensions, the spacing of the externally accessible leads, and hence of all connecting wires is increased since the longitudinal dimension of the pinch seal remote from the discharge vessel is increased with respect to the diameter of the discharge vessel. Resistance against flash-over upon application of a high-voltage starting pulse to the discharge lamp between the leads to the electrodes thus is effectively and inexpensively improved.

DRAWINGS

FIG. 6 is an illustration similar to FIG. 1, and showing the lamp for spreading with mutually parallel spreader jaws;

FIG. 7 is an illustration similar to FIG. 2, illustrating the spread and widened softened portion of the tubing;

FIG. 8 is an illustration similar to FIG. 3 and is an end view of the lamp after withdrawal of the spreader jaws; and FIG. 9 is a side view of an embodiment of a finished lamp.

DETAILED DESCRIPTION

Figure 1:
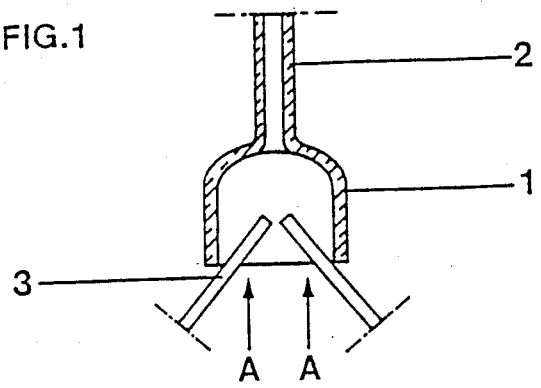
FIG. 1 is a schematic longitudinal cross-sectional view through a lamp subassembly, showing lamp tubing with a pump tube attached, and introduction of spreader jaws.

A circular cylindrical tubing 1, of hard glass or, usually, of quartz glass, has a pump tube 2 joined thereto. The pump tube is used to evacuate the lamp, after the pinch seal has been formed, and also to introduce a predetermined fill into the then formed discharge vessel. Both the tubing 1 as well as the pump tube 2 preferably are made of quartz glass.

In accordance with a feature of the invention, the region of the tubing 1 in which the pinch seal is to be formed, is preheated to plastically deformable temperature and then two spreader jaws 3 are introduced into the softened portion. As can be seen from FIG. 1, the spreader jaws 3 form an acute angle with respect to each other. The spreader jaws are so secured to a holding apparatus that they can carry out a longitudinal stroke within the lamp, as illustrated by arrows A, A in FIG. 1, as well as lateral movement to spread them apart, as seen by arrows B, B in FIG. 2.

To carry out the spreading, the quartz glass is heated to a softening temperature or softening point. Thereafter, the spreader jaws are introduced along the longitudinal axis of the circular cylindrical tube 1, see FIG. 1, arrows A, A, and then the jaws are moved laterally apart, see arrows B, B in FIG. 2. This causes a portion of the circular cylindrical tube to be so spread apart that the outer or terminal edge of the tubing 1 will have an oval cross-sectional shape, see the end portion 4, FIG. 3. This results in an opening having a width in which the longer dimension is greater than the cross section of the original circular cylindrical diameter of the tubing 1—as clearly seen in FIG. 3.

The spreading can be carried out in a single working step on a separate machine, or on a turret-like machine, as an additional operating step. The subsequent sealing step can then be carried out on the turret of the turret machine. The remaining portion of the circular cylindrical tube 1, which faces the pump tube 2, will form the discharge vessel 11 when the lamp is completed; during the spreading step by the spreader jaws 3, it will retain its original circular shape.

Figure 2:
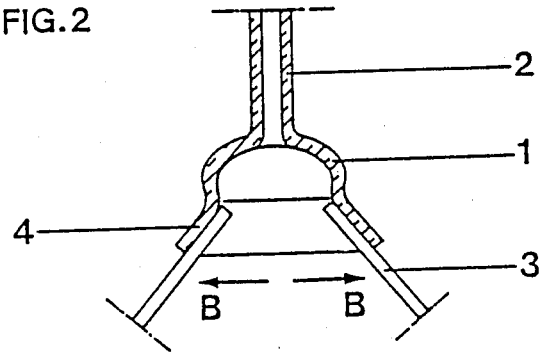
FIG. 2 is an illustration similar to FIG. 1 and illustrating spreading of the softened portion of the tubing in a next working step.
Figure 3:
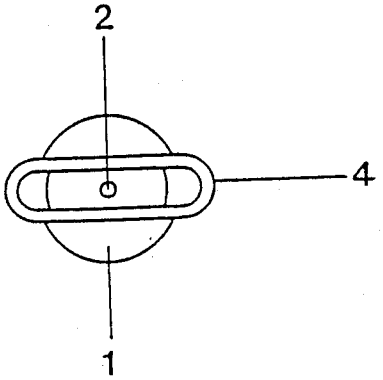
FIG. 3 is an end view of the tubing, after withdrawal of the spreader jaws.

After spreading apart the lamp end portion—see FIG. 2—the jaws 3 are preferably withdrawn and a subassembly which includes the electrodes, sealing foils and externally accessible leads is introduced into the lamp, the sealing foils being located in the region where the pinch seal 10 (FIG. 4) will be made. Except for the shape of the subassembly—which differs from that of the prior art to obtain the improved separation of the externally accessible leads—the remaining working steps are well known and can be in accordance with any suitable production method.

Figure 4:
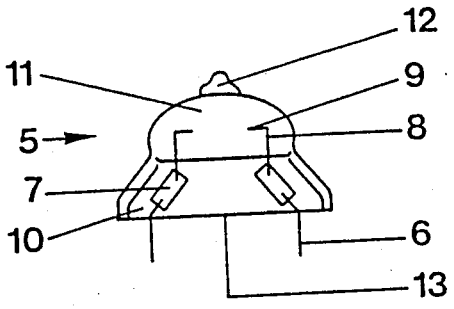
FIG. 4 is a side view of a finished lamp.

In accordance with a first embodiment of the lamp 5—see FIG. 4—made according to the just described process, the electrode subassembly includes externally accessible current supply leads 6 of tungsten, sealing foils 7 made of molybdenum, and inner electrode leads 8 from which the actual electrode tips 9 extend, facing each other. The inner electrode leads 8 as well as the electrode tips 9 are likewise made of tungsten. Typically, the external leads 6 and electrode leads 8 are connected to the foils 7 by welding. The subassembly of external leads 6, foils 7, inner leads 8 and electrode tips 9 is so arranged that the foils 7 extend at an angle with respect to each other, as best seen in FIG. 4. The pinch seal 10 then will securely hold and embed the sealing foils 7 in the previously conically spread portion 4, the sealing foils 7 being placed at an acute angle with respect to each other. The various operating steps of introducing the electrodes and forming the pinch seal are conventional. After forming the pinch seal and sealing-in the foils 7, the vessel 11 is evacuated, filled, and the pump tube 2 tipped off, so that only a molten tip 12 will remain.

The spacing of the current supply leads 6, carried out at the end surface 13 of the pinch seal, may be about 20 mm. At a nominal power rating of about 35 W of a lamp 5, the ignition high-voltage may be more than 6 $kV_p$.

Figure 5:
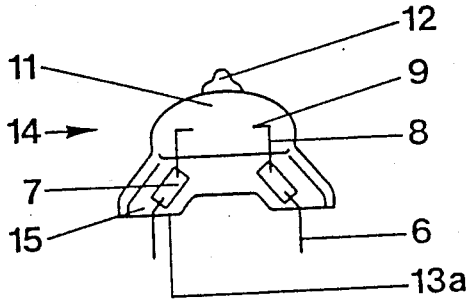
FIG. 5 is a side view of another embodiment of the finished lamp.

It is not necessary that the end face and, hence, the pinch seal 10 be a continuous straight region. In order to provide an elongated creep path for possible spurious discharges along the edge of the surface of the pinch seal, the pinch seal 15 (FIG. 5) can be so arranged that it is slightly recessed with respect to a theoretical straight line—see FIG. 5—so that the end region 13*a* will have an inwardly depressed aspect. The particular shape which the pinch seal will have, at the final production, can be determined by the shape of the pinch or press jaws which will form the pinch seal, that is, whether a straight transverse end 13 or a depressed or otherwise non-straight zone between the end portions of the externally accessible leads 6 is desired. The arrangement of FIG. 5 is particularly suitable for lamps which are difficult to ignite, so that they require a higher voltage pulse than lamps which fire easier. All elements in the lamp 14 of FIG. 5 which are identical to the lamp 5 have been given the same reference numerals.

The particular shape of the pinch seal which is finally made after the tubing has been spread apart by the spreader jaws 3 can be determined by the relative alignment of the spreader jaws with respect to each other and need not be as described, that is, at an angle (FIG. 1). Referring to FIG. 6: Spreader jaws 23 are introduced into the pre-heated, plastically deformable end of the tubing 1, which spreader jaws extend parallel to each other and parallel to a theoretical axis of symmetry of the tubing 1, with the pump tube 2 attached. The spreader jaws are introduced, as before, in the direction of the arrows A, A. The spreader jaws, as before, can be moved in the direction of the arrows A, A and then spread apart in the direction of the arrows B, B, see FIG. 7.

Prior to spreading the spreader jaws 23 apart, the region of the tubing 1 which is to be spread is heated to plastically deformable or softening state and then, with the spreader jaws 23 introduced into the tubing, the spreader jaws are spread apart—compare FIGS. 6 and 7—in accordance with the arrows B, B, so that the final shape of the tubing will be essentially circular—cylindrical in the region where the discharge zone or discharge vessel will be formed, with an oval-cylindrical end portion where the pinch seal will be formed, caused by the spread-apart spreader jaws 23. The shape of the end portion 24 is best seen in FIG. 8 which, however, in contrast to the shape of the end portion in FIG. 3, will have side walls which are parallel to the axis of the lamp, rather than in inclined, oval, part-conical form.

The spreading step can be carried out as a separate spreading step on a separate machine or as a spreading station on a circular lamp manufacturing machine, in which a spreading station is placed on a turret, just in advance of the pressing or pinching step following spreading of the end portion of the tubing 1. During spreading of the spreader jaws 23, the region of the tubing which is to form the discharge vessel will retain its original form—see FIGS. 6 and 7.

A lamp made in accordance with the process just described is shown in FIG. 9. After spreading, an electrode subassembly is introduced into the circular cylindrical tube 1 through the spread-apart end portion. The subassembly, as before, has external current supply leads 26 made of tungsten, sealing foils 27 of molybdenum, and inner current supply leads 8 and electrodes 9, likewise made of tungsten. The sealing foils 2 are located in the spread-apart, widened form of the pinch seal 210. All these steps are conventional. The lamp, after forming the pinch seal 210, then is evacuated, filled and tipped off, so that only the tip 12 remains. The electrodes are located within the discharge space, chamber or vessel 11 (FIGS. 4, 5, 9).

The spacing of the current supply leads 26 carried out from the pinch seal 210 can be substantially extended over the spacing of prior art lamps, since the leads 26 can be connected with an angled-off portion to the foils 27. The foils 27 may extend either parallel to the central axis of the lamp—see FIG. 9—or at an angle, see FIGS. 4, 5. For simplicity of manufacture, the arrangement shown in FIG. 9 is preferred. The spacing of the externally accessible current supply leads 26, extending from the end face 213 of the lamp of FIG. 9 is, for example, 20 millimeters for a lamp 25 of nominal power of 35 W. Ignition high-voltage of more than 6 $kV_p$ can readily be applied to a lamp of this type. The end face 213, FIG. 9, is shown straight although, of course, an undulating or depressed end face similar to the lamp of FIG. 5 may also be used, the final shape of the pinch seal 210 being determined by the shaping of the pinch jaws forming the pinch seal. The pinch jaws are not shown specifically since they may be of any well known standard construction used in the lamp manufacturing industry.

Various changes and modifications may be made, and features described in connection with any one of the embodiments may be used with any of the others, within the scope of the inventive concept. For example, the spreader jaws could be introduced in parallel condition—FIG. 6—and then angled or spread—see FIG. 2—rather than already in angled condition (FIG. 1). If the spreader jaws are retained parallel to form a lamp as shown, for example, in FIG. 9, the leads 26 are preferably sharply angled to place a major portion of the horizontally extending (in FIG. 9) leads 26 within the pinch seal leading to the connection to the foils 27. While the foils 27, embedded in the pinch seal, will not be spaced farther apart than customary in the lamps, the leads themselves will be spaced. Alternatively, of course, if it is desired to also space the foils, the angled-off portion may be placed at the region of the connection of the eletrodes 8 to the foils 27, and the leads 26 brought out straight from the foils 27.

In a lamp of 35 W power rating, for example of the type high pressure metal halide discharge lamp, the following dimensions were used:

diameter of tubing 1: 7.5 mm longitudinal inner dimension of pre-formed oval zone 4, 24: 18 mm (FIGS. 4, 5); 16 mm (FIG. 9)

electrode system, tungsten wires 6, diameter 0.6 mm molybdenum foils (7, 27) thickness: 30 μm, length: 6.5 mm (FIGS. 4, 5); 7.5 mm (FIG. 9).

In prior art lamps, the inner edge-to-edge spacing of current supply leads 6 was: 7 mm.

In the lamp of the present invention, the inner edge spacing of the current supply leads 6 could be increased to: 17 mm (FIGS. 4, 5); 15 mm (FIG. 9).

Final maximum diameter of pinch or press seal 10, FIG. 4: 22 mm.

Diameter of tubing 1 of lamp 25, FIG. 6: 7.5 mm.

Final maximum dimension of pinch seal 210 of the lamp, FIG. 9: 20 mm.

All lamps were made with essentially identical power rating, except as otherwise noted. Auxiliary apparatus provided lamp igniting or starting pulses of 6 $kV_p$ to the respective external electrodes.

We claim:

1. Method of making a single-ended metal halide high-pressure discharge lamp utilizing the steps of providing hard or quartz glass tubing (1) of circular cross section to later form a discharge vessel for the lamp, providing, and connecting a pump tube (2) to the tubing;

heating a portion of the glass tubing (1), spaced from the attachment of the pump tube, to a temperature sufficient to render the glass of the tubing (1) to become plastically deformable;

providing a subassembly of an electrode system comprising external current supply leads (6, 26), sealing foils (7, 27) and electrodes (8, 9) secured to the sealing foils;

introducing the subassembly of the external current supply leads, sealing foils and electrodes into the glass tubing in the region of the glass tubing which has been heated to plastically deformable temperature;

forming a pinch seal (10, 210) by moving pinch jaws from diametrically opposite sides of the tubing in the heated region of the tubing;

evacuating and filling the discharge vessel (11) defined between the connection to the pump tube and the thus formed pinch seal, and tipping off the discharge vessel, and, in accordance with the invention, further comprising the steps of introducing spreader jaws (3, 23) into the heated plastically deformable portion of the glass tubing;

spreading apart said spreader jaws, to pre-deform the heated plastically deformable portion of the glass tubing to have an oval, elongated shape, the oval having a large diameter greater than the diameter of the tubing;

then carrying out the step of introducing said subassembly through the oval-shaped portion of the glass tubing after the heated region of the tubing has been pre-deformed; and then carrying out the step of forming the pinch seal including forming a predetermined final cross-sectional shape of the pinch seal.

2. The method of claim 1, wherein the spreader jaws (3) define an acute angle with respect to each other upon introduction into the heated portion of the glass tubing;

and the spreader jaws are spread apart, maintaining an acute angle with respect to each other to deform the heated plastically deformable portion of the glass tubing to have said oval elongated shape in which the large diameter of the oval, at the portion of the spreader jaws farther apart from each other, will have a diameter greater than the diameter of the tubing whereas the portion of the spreader jaws in the region of the discharge vessel is at least approximately the same as the diameter of said provided hard or quartz glass tubing.

3. The method of claim 2, including the step of placing the sealing foils of the subassembly at an angle with respect to each other to locate the positions of the sealing foils (7) remote from the electrode leads (8) at a distance from each other which is greater than the spacing of the sealing foils at a location where the electrode leads (8) are attached to the sealing foil.

4. The method of claim 2, wherein the step of forming the pinch seal includes the step of forming the end wall of the pinch seal remote from the discharge vessel (11) in a non-straight portion to increase the creep path between current supply leads connected to the sealing foils (7).

5. High-pressure metal halide discharge lamp with improved electrode lead separation and high-voltage flash-over resistance made in accordance with the method claimed in claim 2, wherein the sealing foils (7) within the pinch seal (10, 15) extend at an acute angle with respect to each other, the spacing of the sealing foils adjacent the discharge vessel (11) being less than the spacing of the sealing foils in a portion remote from the discharge vessel (11).

6. The lamp of claim 5, wherein a portion of the sealing foils (7) adjacent the outer edge (13, 13*a*, 213) of the pinch seal are wider apart than the portions of the sealing foils adjacent the discharge vessel (11).

7. The method of claim 1, wherein the step of forming the pinch seal includes the step of forming the end wall of the pinch seal remote from the discharge vessel (11) in a non-straight portion to increase the creep path between current supply leads connected to the sealing foils (7).

8. The method of claim 1, wherein said spreader jaws extend parallel to each other during the step of introducing the spreader jaws into the plastically deformable portion of the glass tubing and the spreader jaws are spread apart while maintaining the essentially parallel relationship to pre-deform the heated plastically deformable portion of the glass tubing to have an oval elongated shape, in which the oval has said large diameter greater than the diameter of the provided glass tubing essentially throughout the extent of the pre-deformed portion of the glass tubing.

9. High-pressure metal halide discharge lamp with improved electrode lead separation and high-voltage flash-over resistance made in accordance with the method claimed in claim 8, wherein the spacing of the current supply leads (26) emanating from the pinch seal (210) is wider than both the diameter of the provided glass of quartz tube and wider than the outer diameter of the discharge vessel (11).

10. High-pressure metal halide discharge lamp with improved electrode lead separation and high-voltage flash-over resistance made in accordance with the method claimed in claim 8, wherein the sealing foils (27) are connected to at least one of: the electrode leads (8); the current supply leads (26) by an angled-off portion having a substantial extent within the larger width of the oval of the pinch seal.

11. The method of claim 8, wherein the step of forming the pinch seal includes the step of forming the end wall of the pinch seal remote from the discharge vessel (11) in a non-straight portion to increase the creep path between current supply leads connected to the sealing foils (7).

12. The method of claim 1, wherein the step of introducing said spreader jaws comprises introducing spreader jaws into the heated plastically deformable portion of the glass tubing and then spreading the portions of the spreader jaws adjacent the end surface (13) of the glass tubing subsequently forming the pinch seal apart so that the spreader jaws will assume an acute angle with respect to each other, to pre-deform the heated plastically deformable portion of the glass tubing to have an oval, elongated shape at least in the region of the end (13) of the glass tubing, the oval having a large diameter greater than the diameter of the tubing, and the region of the pre-deformed portion adjacent the discharge vessel (11) having an essentially circular diameter of essentially the diameter of the provided harder quartz glass tubing.

13. High-pressure metal halide discharge lamp with improved electrode lead separation and high-voltage flash-over resistance made in accordance with the method claimed in claim 1, wherein the external current supply leads (6, 26) emanate from the pinch seal (10, 15, 210) by a distance which is greater than the diameter of the discharge vessel (11).

14. The lamp of claim 13, wherein the end face of the pinch seal is a non-straight or flat surface to provide an elongated creep path between said electrode leads (6, 26).

15. High-pressure metal halide discharge lamp with improved electrode lead separation and high-voltage flash-over resistance made in accordance with the method claimed in claim 1, wherein a portion of the sealing foils (7) adjacent the outer edge (**13, 13*a*, 213) of the pinch seal are wider apart than the portions of the sealing foils adjacent the discharge vessel (11**).

* * * * *